US006038845A

United States Patent [19]

Machnik et al.

[11] Patent Number: 6,038,845

[45] Date of Patent: Mar. 21, 2000

[54] METHOD FOR CHANGING THE BOBBINS IN A ROVING FRAME

[75] Inventors: Franz Machnik, Göppingen; Hans-Peter Weeger, Hattenhofen, both of Germany

[73] Assignee: Zinser Textilmaschinen GmbH, Ebersbach/Fils, Germany

[21] Appl. No.: 09/000,435

[22] PCT Filed: Jun. 28, 1997

[86] PCT No.: PCT/DE97/01387

§ 371 Date: Jan. 30, 1998

§ 102(e) Date: Jan. 30, 1998

[87] PCT Pub. No.: WO98/02603

PCT Pub. Date: Jan. 22, 1998

[30] Foreign Application Priority Data

Jul. 16, 1996 [DE] Germany ..... 196 28 667
Apr. 25, 1997 [DE] Germany ..... 197 17 523

[51] Int. Cl.[7] ..... D01H 9/00

[52] U.S. Cl. ..... 57/267; 57/67; 57/70

[58] Field of Search ..... 57/67, 264, 276, 57/277, 266, 267, 70

[56] References Cited

U.S. PATENT DOCUMENTS

| | | | |
|---|---|---|---|
| 4,409,785 | 10/1983 | Nakane et al. | 57/78 |
| 4,551,969 | 11/1985 | Kogiso et al. | 57/264 |
| 5,259,179 | 11/1993 | Sekiya et al. | 57/264 |
| 5,341,633 | 8/1994 | Nishikawa et al. | 57/264 |
| 5,560,193 | 10/1996 | Sekiya et al. | 57/277 |
| 5,904,036 | 5/1999 | Machnik et al. | 57/67 |

FOREIGN PATENT DOCUMENTS

| | | | |
|---|---|---|---|
| 0 455 254 A2 | 11/1991 | European Pat. Off. . | |
| 1 382 200 | 11/1964 | France . | |
| 2 482 631 | 11/1981 | France . | |
| 31 19 000 C2 | 2/1982 | Germany . | |
| 4-11025 | 1/1992 | Japan | 57/67 |
| 4-352821 | 12/1992 | Japan | 57/264 |

OTHER PUBLICATIONS

Melliand Textilberichte Prof. Dr. sc. techn. Roland Backmann, Dr.–Ing. Gerhard Laux, Dr.–Ing. Mathiaas Pfalz, pp. 7 to 9.

"Weiterentwicklung des Flyers" by R. Backmann et al., Mellian Textilberichte 69 (1988) Jan. No. 1.

"Multimotor Drives for Textile Machines", EAAT GmbH Chemnitz Germany, publication date Sep. 19, 1995.

*Primary Examiner*—William Stryjewski
*Attorney, Agent, or Firm*—Herbert Dubno

[57] ABSTRACT

A process for bobbin replacement on a flyer frame provided with a drafting frame, flyers, spindles and a bobbin rail, in which, while the flyer frame is running, a sliver end for each sliver supplied by the drafting frame is placed upon an empty bobbin sleeve. Initially only the flyers and the spindles of the flyer are driven. The flyers and the spindles are either immediately advanced in a forward direction or are initially driven backwards and after the lapse of a predetermined time period, brought to standstill and then driven forwardly, whereby the standstill of the flyers and the spindles coincide in time or are offset in time. After the start of the forward drive of the flyers and the spindles, the time-delayed drafting frame is set into operation.

15 Claims, 2 Drawing Sheets

METHOD FOR CHANGING THE BOBBINS IN A ROVING FRAME

SPECIFICATION

CROSS REFERENCE TO RELATED APPLICATIONS

This application is a national stage of PCT/DE97/01387 filed Jun. 28, 1997 and based upon German national applications 196 28 667.0 filed Jul. 16, 1996 and 197 17 523.6 filed Apr. 25, 1997 under the International Convention.

FIELD OF THE INVENTION

The invention relates to a process for bobbin replacement on a roving machine provided with a drafting frame, flyers, bobbins and a bobbin rail, in which while the roving machine is running, a sliver end of each sliver supplied by the drafting unit is applied to an empty sleeve.

BACKGROUND OF THE INVENTION

Generally in the state of the art, after a bobbin replacement on a roving machine, in which the pressing fingers generally remain in outwardly swung positions, from the guide eye of the pressing finger end the sliver end hanging out must be applied to the new empty sleeve. For this purpose the sleeve is provided with a sliver catcher region, for example, in the form of a so-called burr strip which engages the sliver end when it is applied to the sleeve. To achieve this, the roving machine is set into operation whereby the pressing finger under the effect of centrifugal force comes to lie against the sleeve.

Roving machines with single drives thus apply the driving force to all of the elements, i.e. the drafting frame, the flyers, the bobbins and the bobbin rail simultaneously. Since the application of the pressing finger against the sleeve and thus the acquisition of the sliver by the sleeve can be effected only when a certain minimum speed is reached, the sliver is not seized for the first few rotations. The sliver, during this interval, is not drawn from the drafting frame and since the latter is in operation, a sag develops in the sliver between the drafting frame and the flyer head. As a result, the sliver can loop around the flyer head which can give rise to a breakage in the sliver when the roving frame is not temporarily stopped and the sleeve rotated by hand. In any case, the sag in the sliver must be eliminated by the take-up of the excess between the flyer and the bobbin.

Similar problems are found also for roving machines with separately controllable drives of the flyer, the bobbin, the drafting unit and the bobbin rail.

OBJECT OF THE INVENTION

The present invention has as its object to provide a process and a corresponding apparatus for bobbin replacement in which this problem is obviated and whereby it can be ensured that the sliver end is engaged in a reliable manner such that undesired sag between the drafting frame and the flyer head is avoided.

SUMMARY OF THE INVENTION

This object is achieved according to the invention in that initially only the flyers and the spindles (but not the drafting frame) of the roving machine are driven. The flyers and the spindles are either driven immediately forwardly or are initially driven backwards, are brought to standstill after a given time interval and then are driven forwardly, whereby the standstill of the flyers and the spindles can coincide or are offset in time.

After the start of the forward drive of the flyers and bobbins, the drafting frame which has been delayed in operation for a time interval, is set into operation.

By "forward drive" is meant the drive of the flyer and bobbin in the normal sense of rotation while "backwards drive" of the flyer and the bobbin means rotation in the sense opposite normal rotational direction.

For application of the sliver to the sleeve only the flyers and the spindles are set in rotation preferably with the same speed, while the drafting frame remains at rest. As a result, the pressing finger and the sliver come to lie against the sleeves without the formation of a sag of the supplied but not gripped sliver. Only thereafter is the drafting frame set into operation and, indeed, with a slowed supply for example for a length of about 5 centimeters, whereby the sliver end which has been brought into contact with the burr strip, is securely engaged. Only thereafter is the roving machine restored to its normal production rate.

The flyers and the bobbins can run with the same rotary speed for the application of the respective sliver ends. However, it is possible to initially operate the drafting frame only at a reduced supply rate.

According to a further feature of the invention, the bobbin rail drive is actuated after successful operation of the flyers and bobbins or after successful operation of the drafting frame has commenced. The movement of the bobbin rail is, however, delayed to the latest at the point at which the sliver ends are gripped by the burr strips of the sleeves.

In an apparatus with separate controllable drives of the individual units, a control unit can be provided for simultaneously operating the flyers and bobbins and for a time-delayed drive of the drafting frame according to the invention. The drive for the bobbin rail can also be connected with the control unit.

In a system with a single drive, a control unit can be provided for the coupling of the single drive with the drafting frame. Furthermore, the bobbin rail drive can be connected by a clutch operated by the control unit, with the main drive.

BRIEF DESCRIPTION OF THE DRAWING

The above and other objects, features, and advantages will become more readily apparent from the following description, reference being made to the accompanying drawing in which:

FIG. 1 shows a roving machine 1 with a drafting frame 2, flyers 3, spindles 5 and a bobbin rail 6. The flyers 3 are journaled in a flyer rail 4.

Figure 1:
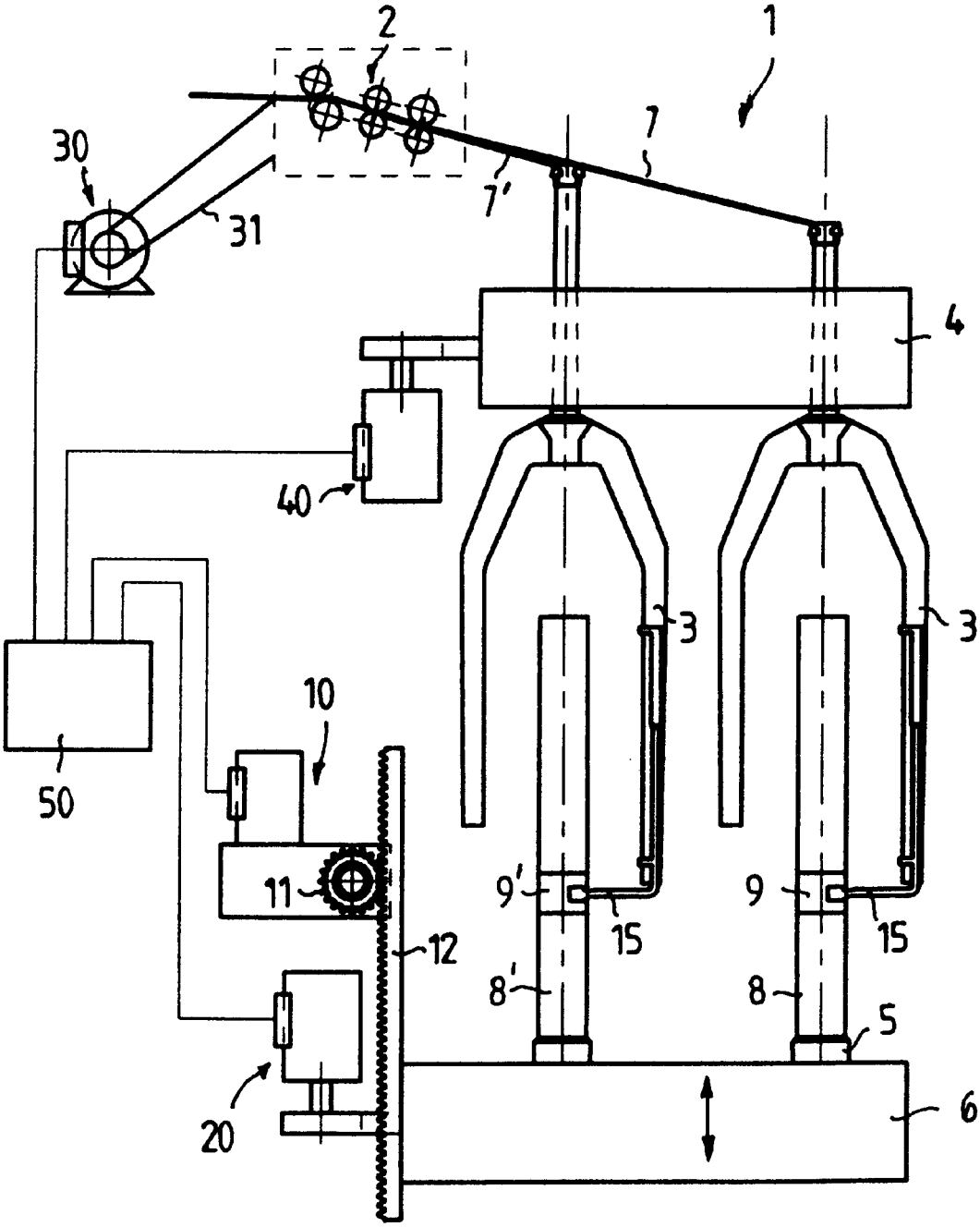
FIG. 1 is a schematic side elevational view of a roving machine with two rows of flyers with separate and separately controllable drives for the individual units.

The spindles 5 carry empty sleeves 8, 8' with sliver-capturing regions 9, 9', preferably in the form of burr strips. The flyers 3 have pressing fingers 15 with corresponding pressing finger tips.

The bobbin rail 6 is vertically movable in the direction of the arrows with the aid of a bobbin rail drive 10 via a gear 11 and a rack 12.

For the drive of the spindles 5, a drive 20 with a corresponding transmission is provided. The flyers 3 are driven via a drive 40 and corresponding intermediate transmissions; for the drafting frame 2, a drafting frame drive 30 is provided with motion transfer elements 31. The drives 10, 20, 30 and 40 are interconnected by a common control unit 50.

With the aid of this control unit 50, the flyers 3 and bobbins 5 are initially driven, i.e. the corresponding drives 40 and 20 are turned on. Thus the system provides for the possibility that the flyers 3 and the bobbins 5 will run with the same rotary speed for application of the respective sliver ends.

After start of the forward drive of the flyers 3 and the spindles 5, the time-delayed drafting frame 2 is set in operation via the drive 30 whereby the sliver ends hanging out of the tips of the pressing fingers 15 for the slivers 7 and 7' can be adhered to the respective empty sleeve 8 or 8' with the aid of the sliver capturing means 9 and 9'. The drafting frame 2 initially can be set in operation with a reduced supply rate.

It is, further also possible for the movement of the bobbin rail 6 to commence at the latest, once the sliver 7 and 7' are engaged.

FIG. 1 thus relates to an apparatus with separately controllable drives 10, 20, 30 and 40 for the flyers 3, the bobbins 5, the drafting frame 2 and the bobbin rail 6. The control unit 50 connected with these drives effects simultaneous operation of the flyers 3 and the spindles 5 with time-delayed operation of the drafting frame 2. It also allows for the possibility that the drive 20 of the bobbin rail 6 will be connected to the control unit 50.

Figure 2:
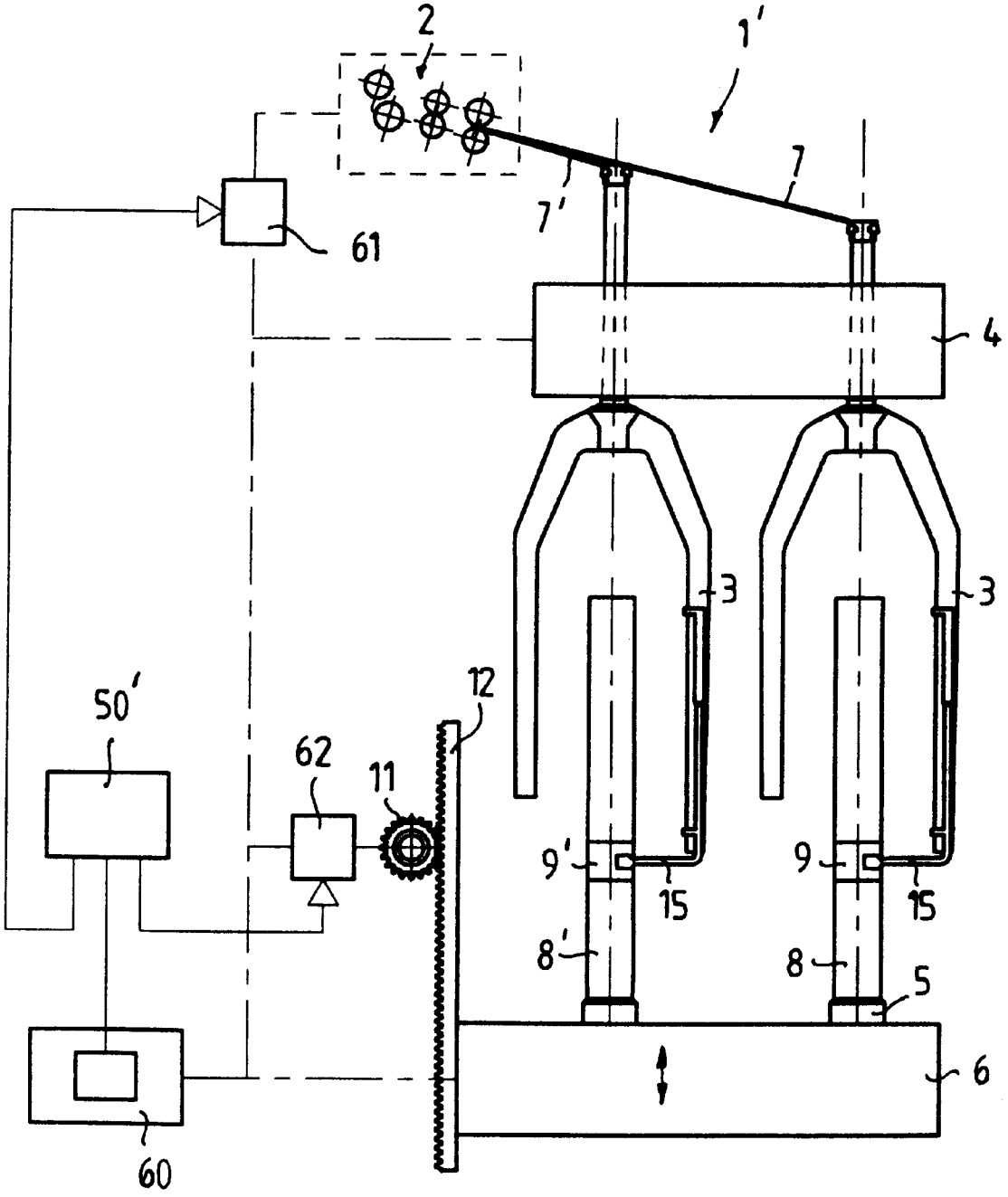
FIG. 2 is a schematic side elevational view of a roving machine with a common drive for the individual units.

FIG. 2 shows another embodiment of the invention in which the roving machine has a common drive 60 for the drafting frame 2, the flyers 3, the bobbins 5 and the spindles rail 6. The common drive 60 is connected with a control unit 50' which, in turn, is connected with a clutch 61 between the drive 60 and the drafting frame 2 and with a clutch 62 between the drive 60 and the bobbin rail 6. Via the control unit 50' and the clutch 61 and 62, initially only the flyers 3 and the bobbins 5 of the roving machine 1' can be driven. After the commencement of the forward drive of the flyers 3 and the spindles 5, the drafting frame 2 is set in operation via the clutch 61 so that the sliver ends of the slivers 7 and 7' can adhere to the respective empty sleeves 8 and 8' with the aid of the sliver capturing means 9 and 9'.

With the present invention it is ensured that with devices for the separate or separately controllable drives for the individual working elements or with the devices for the common drive of the individual working elements, upon the bobbin replacement, in which each sliver end from a sliver supplied by the drafting unit, is applied to an empty sleeve, initially only the flyers 3 and the spindles 5 of the roving machine are driven. After the commencement of forward drive of the flyers 3 and the bobbins 5, with time delay, the drafting frame 2 is set into operation via the drive 30, so that the sliver ends of the slivers 7 or 7' can be adhered to the respective empty sleeves 8 and 8' with the aid of the sliver capturing burr strips 9 and 9'. There is also the possibility of a reduced supply for a length of about 5 centimeters of the sliver whereby the sliver ends can be reliably engaged by the sliver capture regions 9 and 9'. Only then is the roving machine brought up to normal production.

We claim:

1. In a bobbin replacement process for a flyer roving machine in which roving is wound upon sleeves on spindles on a bobbin rail with flyers and spindles driven in a forward direction from sliver fed by a drafting frame to form respective bobbins, full bobbins are removed from the spindles and are replaced by empty sleeves, and a free end of a respective sliver is formed on each flyer, the improvement which comprises the steps of:

(a) upon mounting of an empty sleeve on each spindle initially driving only the respective spindle and flyer to apply a respective one of said free ends to the respective empty sleeve, while the drafting frame is not driven to engage the free ends on the respective sleeves; and (b) thereafter driving said spindles and the respective flyers in the forward direction while driving the drafting frame for winding of respective bobbins on the sleeves.

2. The improvement defined in claim 1 wherein the flyers and spindles are driven forwardly in step (a).

3. The improvement defined in claim 1 wherein initially in step (a) the flyers and spindles are driven in a backward direction and after the lapse of a predetermined time period the flyers and spindles are brought to standstill and thereafter the flyers and spindles are driven in said forward direction.

4. The improvement defined in claim 3 wherein said flyers and spindles are simultaneously brought to standstill in step (a).

5. The improvement defined in claim 3 wherein in step (a) said flyers and spindles are brought to standstill at different times.

6. The improvement defined in claim 1 wherein the driving of the drafting frame in step (b) is initiated with a time delay following the commencement of the driving of the spindles and flyers in said forward direction.

7. The improvement defined in claim 6 wherein said flyers and said spindles are driven with the same speed in step (a) for engagement of the free ends on the respective sleeves.

8. The improvement defined in claim 6 wherein said drafting frame is driven in step (b) initially to deliver sliver to each of said flyers at a reduced rate by comparison with the rate at which sliver is delivered to said flyers for winding of respective bobbins on the respective sleeves.

9. The improvement defined in claim 6, further comprising the step of setting said bobbin rail into operation simultaneously with driving of said flyers and said spindles.

10. The improvement defined in claim 6, further comprising the step of setting said bobbin rail into operation simultaneously with driving of the drafting frame.

11. The improvement defined in claim 6, further comprising the step of setting said bobbin rail into operation only subsequent to the driving of said flyers and said spindles.

12. The improvement defined in claim 6 wherein said bobbin rail is set into operation only after the driving of said drafting frame has commenced.

13. A flyer roving machine comprising:

a bobbin rail carrying a multiplicity of spindles adapted to receive sleeves on which respective bobbins are wound;

respective flyers assigned to said spindles for delivering sliver to said sleeves;

a drafting frame for feeding said sliver to said flyers; and control means effective during a bobbin replacement process in which full bobbins are removed from the spindles and are replaced by empty sleeves and a free end of a respective sliver is formed on each flyer, and connected with drives for said spindles, said bobbin rail, said flyer and said drafting frame for initially driving only the respective spindles and flyers upon mounting of empty sleeves on said spindles to a flyer respective one of said free ends to the respective empty sleeve while the drafting frame is not driven to engage the free end on the respective sleeves, and thereafter driving said spindles and the respective flyers forwardly while driving the drafting frame for winding of respective bobbins on the sleeves.

14. The apparatus defined in claim 13 which has a common drive for the flyers, the spindles, the drafting frame and the bobbin rail, further comprising a clutch connected to said control means and arranged ahead of said drafting frame.

15. The apparatus defined in claim 14, further comprising a clutch connected to said control means and arranged ahead of said bobbin rail.

* * * * *